US006682056B1

(12) United States Patent
West

(10) Patent No.: US 6,682,056 B1
(45) Date of Patent: Jan. 27, 2004

(54) MOUNTING CLIP WITH LOCKING FEATURE

(75) Inventor: Ronald R. West, American Fork, UT (US)

(73) Assignee: Kroy Building Products, Inc., York, NE (US)

( * ) Notice: Subject to any disclaimer, the term of this patent is extended or adjusted under 35 U.S.C. 154(b) by 28 days.

(21) Appl. No.: 09/699,716

(22) Filed: Oct. 30, 2000

Related U.S. Application Data

(60) Provisional application No. 60/191,980, filed on Mar. 24, 2000.

(51) Int. Cl.[7] ..... E04H 17/14

(52) U.S. Cl. ..... 256/65.03; 256/65.01; 256/65.09; 256/19; 256/59; 403/326; 403/329

(58) Field of Search ..... 256/59, 65.01–65.03, 256/65.09, 65.13, 65.14, 65.16, 19; 248/223.41, 224.51, 224.8; 403/315–317, 326, 327, 329

(56) References Cited

U.S. PATENT DOCUMENTS

| | | | | |
|---|---|---|---|---|
| 2,336,385 A | | 12/1943 | Batcheller | |
| 2,773,674 A | | 12/1956 | Fischer et al. | |
| 3,156,282 A | | 11/1964 | Bedford, Jr. | |
| 3,208,778 A | | 9/1965 | Gordon | |
| 3,212,754 A | | 10/1965 | Revell et al. | |
| 3,898,784 A | | 8/1975 | Sauer et al. | |
| 3,994,050 A | * | 11/1976 | Bub | 24/255 TC |
| 4,124,198 A | | 11/1978 | Wong | |
| 4,135,837 A | | 1/1979 | Suttles | |
| 4,165,944 A | | 8/1979 | Sunasky | |
| 4,341,254 A | * | 7/1982 | Schaller et al. | 160/172 |
| 4,625,948 A | | 12/1986 | Lustvee | |
| 4,643,610 A | | 2/1987 | Bien | |
| 4,666,355 A | | 5/1987 | Stover | |
| 4,958,399 A | | 9/1990 | Toal et al. | |
| 5,095,592 A | | 3/1992 | Doerfling | |
| 5,101,540 A | | 4/1992 | Roof et al. | |
| 5,556,079 A | * | 9/1996 | West | 256/22 |
| 5,695,174 A | * | 12/1997 | Tsai | 256/22 |
| 5,951,223 A | | 9/1999 | Lindquist | |
| 6,004,065 A | | 12/1999 | Higdon et al. | |
| 6,039,307 A | | 3/2000 | De Zen | |
| 6,126,146 A | | 10/2000 | Melton | |
| 6,484,465 B2 | * | 11/2002 | Higgins | 52/474 |

FOREIGN PATENT DOCUMENTS

| | | | | |
|---|---|---|---|---|
| CA | 1035-983 | * | 8/1978 | 256/68 |
| GB | 29939 | | of 1897 | |

* cited by examiner

*Primary Examiner*—Lynne H. Browne
*Assistant Examiner*—Michael P. Ferguson
(74) *Attorney, Agent, or Firm*—Clayton, Howarth & Cannon, P.C.

(57) ABSTRACT

A mounting clip with a locking feature. The mounting clip is preferably utilized as part of a fencing system, in which the clip is attached to a fence rail and a hollow fence picket is slidably fastened to the rail using the clip. The clip features tabs that operate to lock the picket to the rail such that detachment of the picket from the rail is inhibited by an interference fit.

78 Claims, 5 Drawing Sheets

MOUNTING CLIP WITH LOCKING FEATURE

CROSS-REFERENCE TO RELATED APPLICATIONS

This application claims the benefit of U.S. Provisional Application No. 60/191,980, filed Mar. 24, 2000.

STATEMENT REGARDING FEDERALLY SPONSORED RESEARCH OR DEVELOPMENT

Not Applicable

BACKGROUND OF THE INVENTION

1. The Field of the Invention

The present invention relates generally to fencing system fastening devices, and more particularly, but not entirely, to a device for securing a picket to a rail in a fencing system.

2. Description of Related Art

It is common practice to construct fencing from a system of vertical posts connected by horizontal rails to which pickets are attached. Commonly, these pieces are connected to each other with nails, screws or bolts. These fasteners have a small surface area of contact against the surface of the piece fastened, resulting in an attachment that may be insecure and easily disconnected. Such fasteners may also operate as protrusions from the fence that can catch on other items.

Fencing systems in which the pickets, rails and posts are constructed of plastic tubes are known. These systems can be constructed to overcome some of the problems associated with fence systems that utilize screws and nut and bolt type fasteners. An example of such a system is disclosed in U.S. Pat. No. 5,556,079, granted Sep. 17, 1996 to West (hereinafter "'079 patent"). This type of system is generally constructed of flat plastic tubes that are connected by clips secured to a railing. An opening is cut in the picket that corresponds to the shape of the clip. The picket is placed on the railing, the opening over the clip, the picket is then moved downward, and the clip secures the picket to the rail by a non-interference, compressive frictional engagement. This compressive frictional type of engagement will be hereinafter referred to as a "friction fit." This system results in a fence in which the fasteners are contained inside the members of the fence, eliminating the problems associated with exposed fasteners. The strength of the attachment connection produced by the metal clip, while effective, is limited by the strength of the friction fit.

As shown in the '079 patent, such a system typically uses mounting clips made from metal, which slide over the edge of the hole in the member. The picket may be easily removed by sliding it upwards, unfastening the clip. One advantage is that the fence may easily be taken down, but strength is compromised. A picket may also be removed by applying force to the picket in a direction away from the rail. The thin metal clip can be bent, and then the clip retains the bent shape. Such systems may also be difficult to assemble, as multiple holes in a picket must be aligned with clips located on separate railings, with no structural feature that assists in the alignment.

The prior art is thus characterized by several disadvantages that are addressed by the present invention. The present invention minimizes, and in some aspects eliminates, the above-mentioned failures, and other problems, by utilizing the methods and structural features described herein.

BRIEF SUMMARY AND OBJECTS OF THE INVENTION

It is therefore an object of the present invention to provide a fastener for constructing a fence system that has greater surface area of contact at the attachment area.

It is another object of the present invention to provide such a fastener which is not exposed to the outside surface of the fence system.

It is a further object of the present invention, in accordance with one aspect thereof, to provide such a fastener which has a locking feature, preventing the picket from being easily removed.

It is an additional object of the invention, in accordance with one aspect thereof, to provide such a fastener which has elastic memory, and which is stronger than the picket clip fasteners known in the prior art.

It is also an object of the present invention, in accordance with one aspect thereof, to provide a means to make assembly of a fence system easier and less laborious, by providing a feature to align picket holes to the fasteners.

The above objects and others not specifically recited are realized in a specific illustrative embodiment of a fence system with an improved mounting clip with a locking feature. The present invention features a locking feature, which prevents the picket from being slidably removed from the fence. The present invention increases the surface area of contact between the fastener and the picket over that of a screw or nut and bolt type fastener. The present invention may be constructed to be concealed inside the members of a plastic tube fence system. Specific embodiments of the present invention may be constructed to have elastic memory, and an alignment feature to allow for ease of construction.

Additional objects and advantages of the invention will be set forth in the description which follows, and in part will be apparent from the description, or may be learned by the practice of the invention without undue experimentation. The objects and advantages of the invention may be realized and obtained by means of the features particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
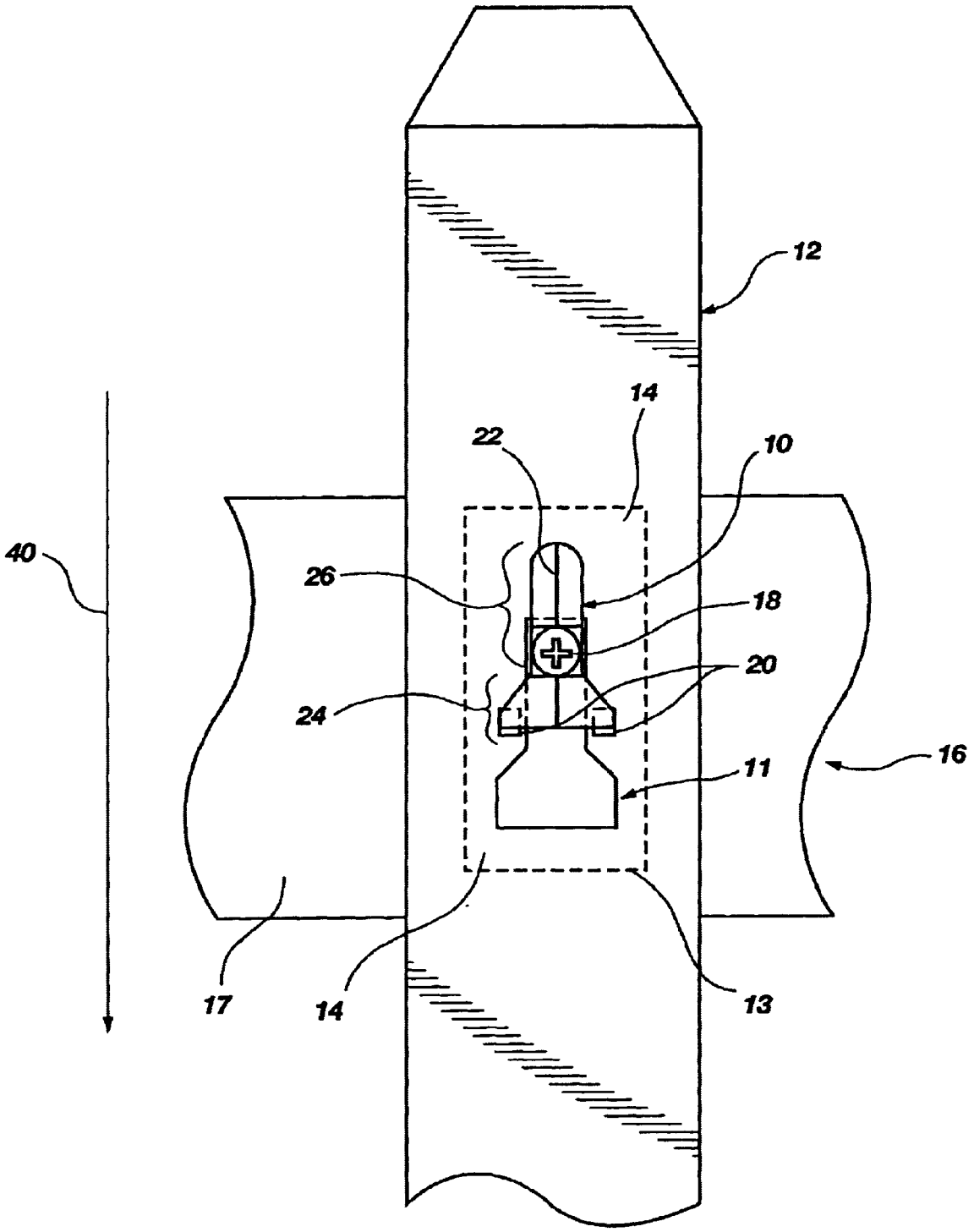
FIG. 1 is a frontal view of an embodiment of a clip constructed in accordance with the present invention, shown installed in a cutaway view of a picket and fence system.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

The invention is directed to a fastener for connecting two members of a fencing system adjacently to each other. To facilitate the understanding of fencing systems, the following terms are understood to take the following meanings:

"Fence rail" as used herein shall refer to a laterally-extending structural member that operates to support fence pickets or fence panels as part of a fence.

"Fence panel" as used herein shall refer to upwardly-extending panels supported by fence rails to form a fence.

"Fence picket" as used herein shall refer also to upwardly-extending members supported by fence rails to form a fence.

"Interference fit" as used herein shall refer to the concept of a connection between two members in which a portion of one member abuts some portion of the other member in a manner that contactably blocks the separation of the two members.

Figure 1A:
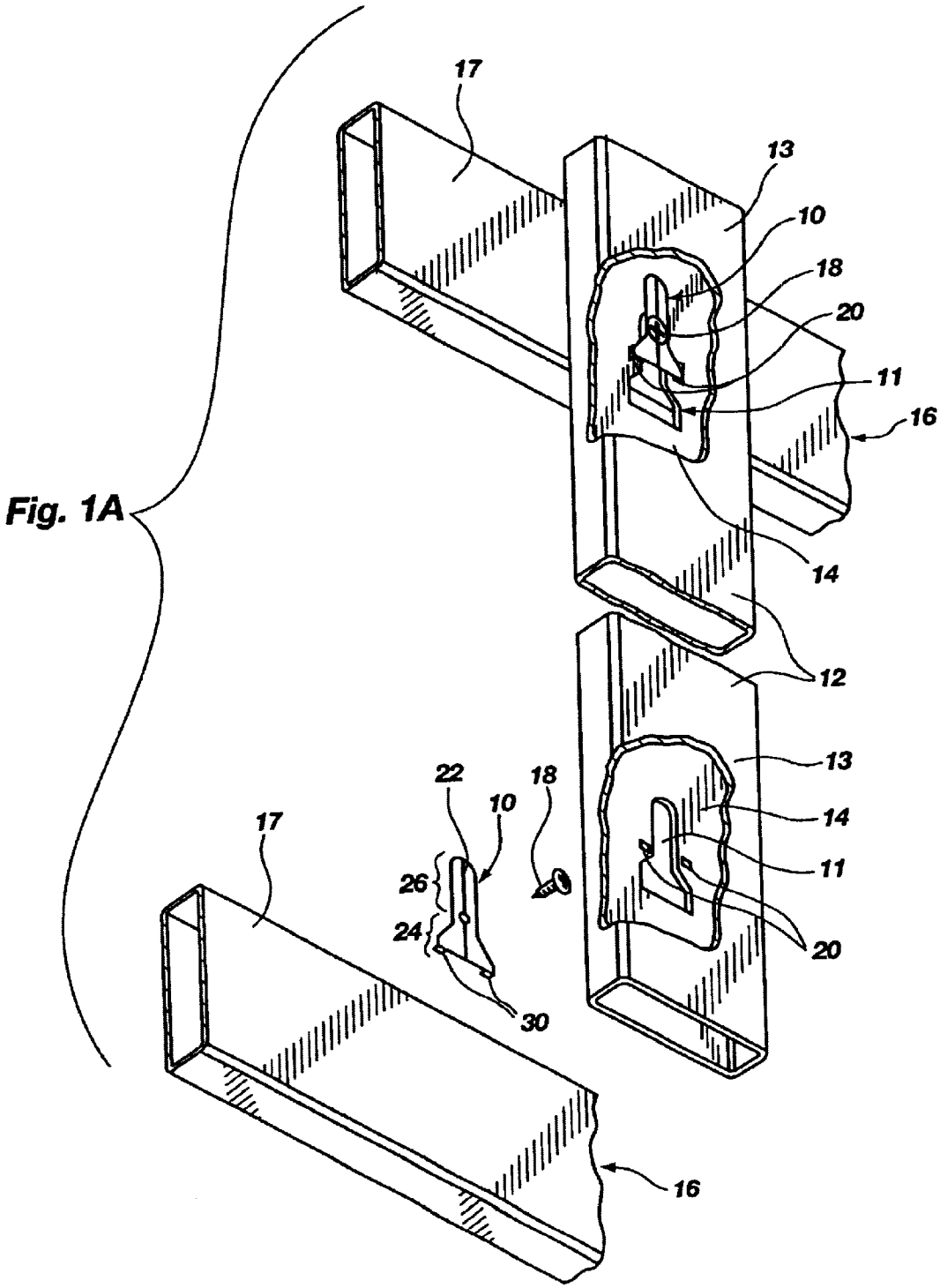
FIG. 1A is a perspective, break-away view of the clip and the picket and fence system of FIG. 1, showing a second rail with an exploded view of the fence system.

FIGS. 1 and 1A show a preferred embodiment of this invention as the installed clip 10. In this figure, clip 10 is preferably rotatably attached to fence rail 16 by the connector 18, which may be a screw or any other suitable fastening means. The clip 10 is preferably made of strong plastic and possesses elastic memory. A hollow picket 12 is fastened to the rail 16 by the clip 10 such that the clip 10 is fitted through an opening 11 formed in the picket 12 so that the clip 10 resides within said picket 12. The picket 12 is preferably constructed of PVC and has a hollow interior although alternative structures may be used. The picket 12 is shown with a portion of its front wall 13 cutaway so the attachment of the clip 10 to a back wall 14 of the picket 12 may be seen. Picket 12 features an opening 11 formed in the back wall 14 to allow the clip 10 to be inserted. The opening 11 is preferably shaped similar to an external outline of the clip 10, which in this embodiment results in a keyhole type shape. Of course, alternative shapes, readily ascertainable to those skilled in the art, may also be used. There are also locking holes 20 which are cut into the back wall 14 of the picket 12. Although this embodiment shows two locking holes 20, it will be understood that the invention includes a locking system that may include a greater or lesser number of locking holes, if desired.

Figure 2:
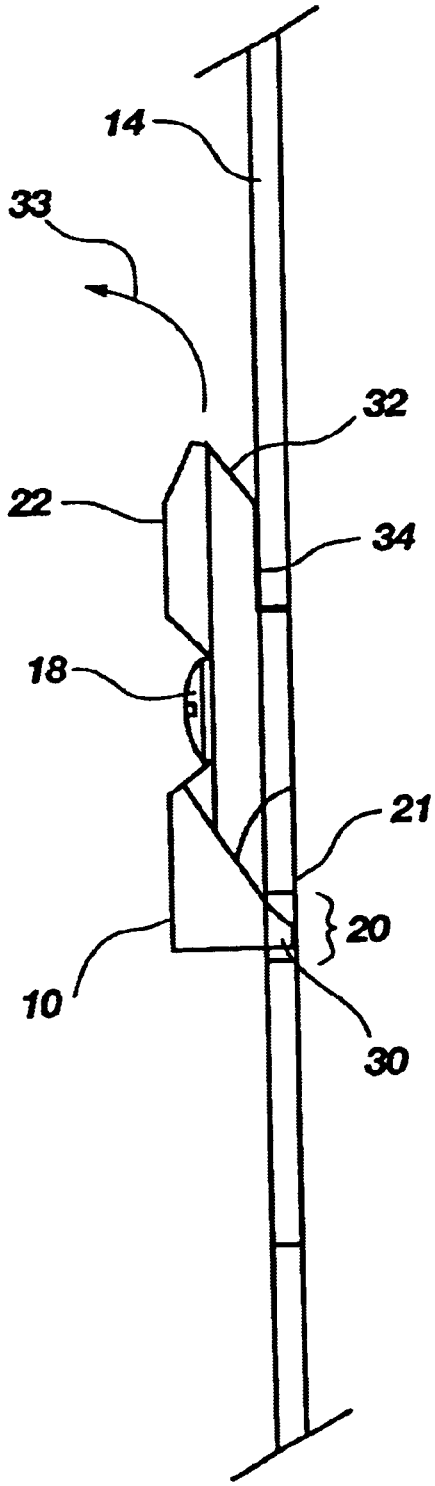
FIG. 2 is a side view of the clip of FIG. 1, and a break-away view of a rear wall of a hollow picket, to which the clip is attached.

Referring now to FIG. 2, there is shown a side view of the clip 10 of FIG. 1, further details of which may be more easily seen. The clip 10 has a nonuniform thickness and includes engagement fingers 30 configured to fit in the locking holes 20, an upper beveled guide edge 32, an engagement surface 34 and an elongate leading entry edge 22.

Figure 3:
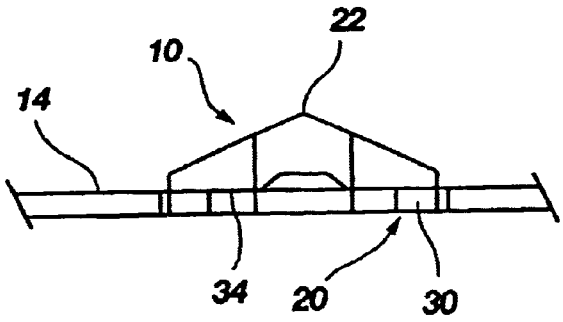
FIG. 3 is a bottom view of the clip shown in FIGS. 1 and 2.

FIG. 3 shows a bottom view of the embodiment shown in FIGS. 1 and 2. As can be seen the clip 10 has a V-shaped cross section angled from the elongate leading entry edge 22, which is the point of the clip 10 furthest from the rail 16. FIG. 3 also illustrates the engagement fingers 30 in an installed position within the locking holes 20.

In operation, the clip 10 is fastened by the connector 18 to the rail 16, yet rotatably disposed around the connector 18. The picket 12 is placed against a front side 17 of the rail 16, such that the clip 10 enters the hollow center of the picket 12, through the opening 11. The picket 12 is then thrust downwardly causing the back wall 14 of the picket 12 to slide into position between the engagement surface 34 of the clip 10 and the front side 17 of the rail 16. The clip engagement fingers 30 thereby slide into position into the locking holes 20 of the back wall 14. The clip 10 holds the rail 16 and the picket 12 firmly together. Accordingly, the clip 10 acts as an attaching means for attaching fence pickets 12 to a rail 16, such that the pickets 12 reside in an-upwardly extending position as shown in FIG.1.

One feature included in the present invention is the inclusion of a means 22 for aligning the opening 11 in a picket 12 to the clip 10. In the embodiment shown in FIGS. 1 and 2, the elongate leading entry edge 22 and V-shaped cross section function to guide this alignment and insertion. By placing any portion of the opening 11 over the outward face of the clip 10, the opening 11 is caused to slide along the back surface of the clip 10 towards the rail 16, away from the leading entry edge 22, which is the point of the clip 10 furthest from the rail 16, placing the clip 10 in the hollow center of the picket 12.

As mentioned briefly above, once the picket 12 has been placed over the clip 10, the picket 12 is moved downwardly in the direction shown by arrow 40, in FIG. 1. The upper, beveled guide edge 32, extends downwardly towards the rail in a proximal-to-distal direction toward the rail terminating at the engagement surface 34. The upper beveled guide edge 32 contacts the back surface 14 first, guiding the picket into the proper position and allowing the clip 10 to temporarily flex away from the rail 16 in the direction indicated by arrow 33 in FIG. 2. The non-uniform thickness of the clip 10, assists the clip in flexing away from the rail 16. The picket back wall 14 slides between the engagement surface 34 of the clip 10 and the rail 16. The contact between the engagement surface 34 and the picket back wall 14 operates to hold the picket 12 in place in a friction fit, in addition to the engagement of the engagement fingers 30 within the locking holes 20 of the picket back wall 14, which further holds the picket 12 in place. As shown in FIGS. 2 and 3 the engagement surface 34, and the two engagement fingers 30 provide a three-point contact that holds the picket 12 to the rail 16. This is accomplished by the upper, narrow elongate portion 26 and the wider lower portion 24 of the clip 10. This feature provides a larger surface area of contact, and three separate spaced-apart contact points to hold the members together than may be done with only a screw or a nail, resulting in a stronger connection between the members.

Figure 2A:
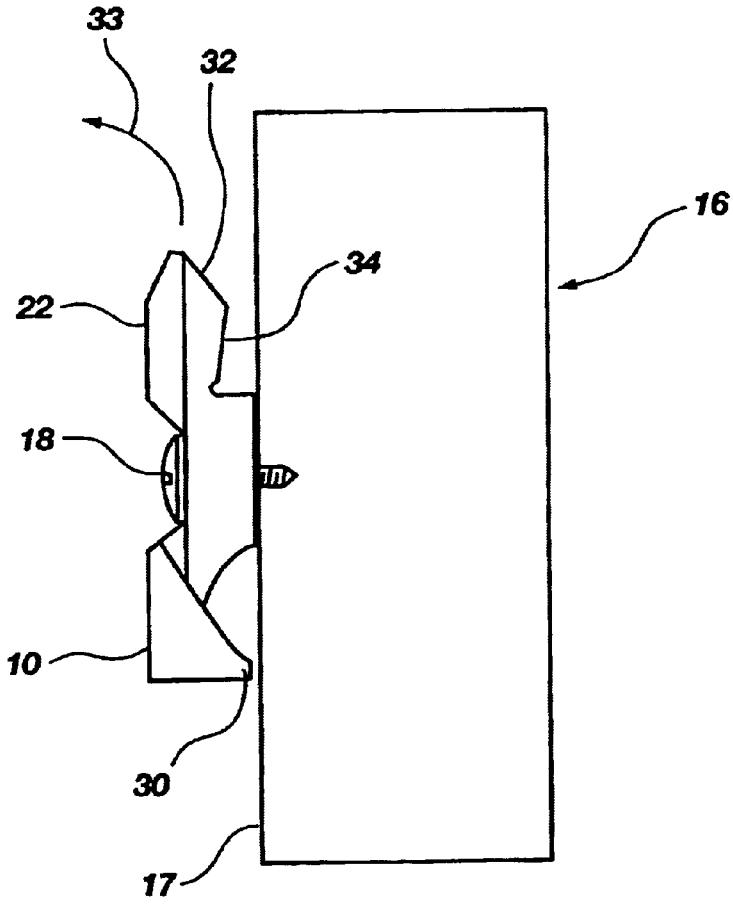
FIG. 2A is a side view of the clip of FIG. 1, shown attached to a fence rail, and in its naturally biased uninstalled position.

It will be appreciated that the engagement surface 34 of clip 10 , when clip 10 is in a naturally biased uninstalled condition is configured so as to be non-parallel to the rail 16, as shown in FIG. 2A. This provides the advantage of a structure that more easily flexes to allow the picket 12 to be inserted, and more firmly grips against the picket back wall 14. One alternative structure within the scope of the present invention is a clip 10, which features an engagement surface 34 that is parallel to the rail 16. Such a structure, while less inclined to flex responsive to the insertion of the picket 12, further increases the surface area of contact for the friction fit, and may result in a stronger attachment. Other alternative structures readily ascertainable to those skilled in the art that are capable of performing the same function of providing a friction fit are also included in the present invention.

As the picket 12 is slid downwardly into place, the elastic memory of the clip 10 forces the engagement fingers 30 to slide into the locking holes 20 when the locking holes 20 are slid into alignment with the engagement fingers 30. Once the engagement fingers 30 have entered the locking holes 20, the picket 12 is secured. If the picket 12 is then slid in the opposite, upward direction, the engagement fingers 30 are held in place by the clip 10 to reside directly in the movement path of the edge 21 of the back wall 14 that forms the locking holes 20, preventing the picket 12 from being removed. This "blocking" interaction between an engagement finger 30 and the wall 14, forms an "interference fit", as there is a connection between two members in which a portion of one member abuts some portion of the other member in a manner that contactably blocks the separation of the two members. It will be appreciated that the interference fit may be formed with an alternative structure that features a single, or a plurality of engagement fingers, and all such structures are included in the present invention. It will further be appreciated that alternative structures featuring engagement members that interact between the clip 10 and the picket 12 which are readily ascertainable to those skilled in the art are also included within the scope of the present invention. The interaction of the engagement fingers 30 with the locking holes 20 thus functions as a fastening means for engaging the picket in an interference fit. This interaction may also be characterized as the interaction of a locking means and a receiving means preventing the picket from being slidably removed.

Once the picket 12 is installed, the rotatable connection of the clip 10 to the rail 16 allows the pickets to be aligned to one another or to uneven ground. The clip 10 is located inside the picket 12, concealing it from view and protecting the clip 10, as well as preventing a person or pet from becoming cut or otherwise injured by contacting the clip 10 if the clip were exposed.

Although the clip 10 may be constructed from any of a number of suitable materials, it is preferable to construct it from a material having elastic memory, having a substantial absence of ductility, and an ability to avoid plastic deformation. Examples of such materials include fiberglass-reinforced nylon plastic, or any suitable plastic, preferably a rigid, molded plastic. Although the plastic from which the clip 10 is constructed preferably comprises elastic memory, it is to be understood that the clip 10 is not highly flexible, having preferably a minimum amount of flexibility necessary to accomplish the functions and operations required of the clip 10 as described herein. The use of a fiberglass-reinforced nylon plastic results in a fastener that has superior retention qualities. A fastener that is constructed of a ductile material, such as the metal fastener found in the '079 patent discussed above in the background section, can be permanently deformed by the application of force to the members, in a direction other than the sliding motion described above. In a fence system this would allow the pickets to be too easily removed from the fence by simply pulling the pickets away from the railing. By using a material that is not ductile, nor highly susceptible to plastic deformation, the fastener is unable to be bent, resulting in a stronger attachment between the members.

Figure 4:
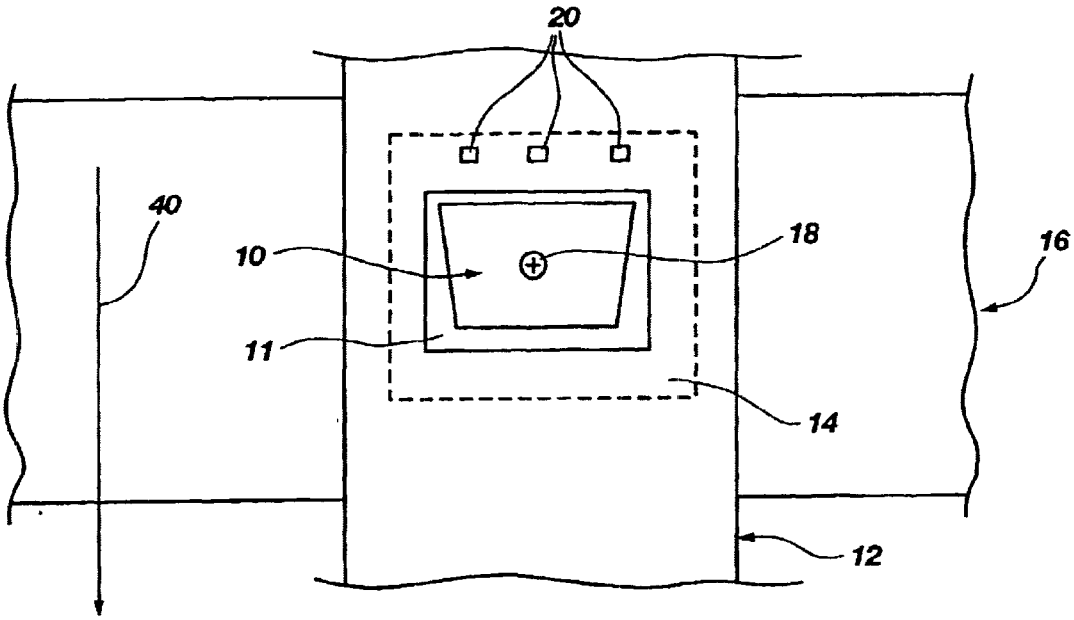
FIG. 4 is a frontal view of a second embodiment of a clip constructed in accordance with the present invention, shown in a cutaway view of a picket and fence system.
Figure 5:
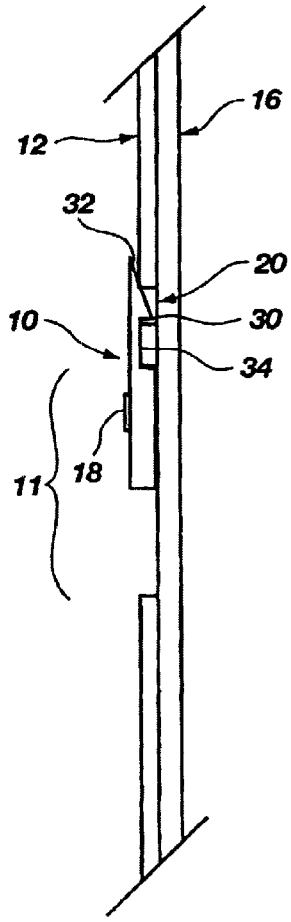
FIG. 5 is a side view of the embodiment shown in FIG. 4.

FIGS. 4 and 5 show a second embodiment of the present invention. In this embodiment, the engagement fingers 30 of the clip 10 are located on the guide edge 32. By locating the engagement fingers 30 at this position, the engagement fingers 30 may be constructed as an extension of the guide edge 32. This is another example of the embodiments that can be constructed which are within the scope of the present invention.

The present invention also includes a method of assembling a fence in which the pickets are guided into proper alignment with the rails by the mounting clips of the system. This method includes the steps of coupling a fastener having elastic memory and a picket guiding means to a rail; selecting a fence picket having a sidewall and an opening formed in said sidewall that is larger that the fastener, such that the fastener guides the opening into alignment with the fastener; and forcibly sliding the picket downwardly to force the sidewall of the picket into engagement with the fastener, such that a portion of the sidewall is compressed between the fastener and the rail.

This method may be accomplished through the use of the fence system shown in FIGS. 1 and 2. The clip 10, of FIGS. 1 and 2, may be rotatably fastened to a rail 16. A hollow fence picket 12 with opening 11 in the sidewall of the picket 12 may be selected, and placed into contact with the clip 10. The elongate leading entry edge 22, and the V-shaped cross section of the clip 10, guide the opening 11, to slide along the back of the clip 10, so as to align the picket 12 to the clip 10. The picket 12 is then forcibly slid downwardly, so the sidewall of the picket is placed between the engagement surface 34 and the rail 12, sandwiched in an interference fit between the upper narrow elongate portion 26 of the clip 10 and the rail 16.

The present invention also includes a method of assembling a fence system in which the pickets are slidably attached to the rail such that they cannot be slidably removed. This method has the steps of coupling a fastener configured for slidable attachment and featuring a locking structure to a rail; selecting a hollow fence picket having a sidewall, and an opening formed in the sidewall that is larger than the fastener and at least one receiving structure formed in the sidewall, and placing the picket over the fastener such that the fastener is inserted into the opening; and forcibly sliding the picket downwardly to engage the sidewall of the picket into engagement between the fastener and the rail such that the locking structure interacts with the receiving structure, preventing the picket from being slidably removed.

This method may be practiced with the structure disclosed in FIGS. 1 and 2. The clip 10, featuring engagement fingers 30, may be rotatably fastened to a rail 16, and a hollow picket 12 with an opening 11 and locking holes 20 may be selected and placed over the clip 10. The picket 12 is then forcibly slid downwardly, and the engagement fingers 30 are inserted into the locking holes 20 to form an interference fit. This locks the picket 12 to the rail 16, preventing the rail from being slidably removed. It will be appreciated that this method may be practiced with alternative structures that feature a single, or a plurality, of engagement members.

It is to be understood that the above-described arrangements are only illustrative of the application of the principles of the present invention. For example, the clip 10 could be constructed without any engagement fingers 30, if desired, such that the attachment by said clip 10 would then be accomplished by frictional engagement. In addition, it may be preferable, when utilizing a fence panel or picket that is much wider than the picket 12 represented in the drawings, to form two side-by-side openings 11 in the upper portion of the picket, and two side-by-side openings 11 in the lower portion, for receiving two pairs of side-by-side clips 10 to engage the upper and lower portions of the picket. If such a wide picket is also quite tall and if the fence design utilizes a center rail, in addition to an upper rail and a lower rail, then a pair of side-by-side openings 11 and side-by-side clips 10 may also be used in conjunction with said center rail and a corresponding mid-portion of the picket.

Numerous other modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A fence system comprising:

a fence rail supportable in a laterally-extending position;

a plurality of fence pickets;

an attaching means for attaching the fence pickets to the fence rail such that said pickets reside in an upwardly-extending position when the fence rail resides in the laterally-extending position, said attaching means comprising a non-metallic member having elastic memory; and wherein the non-metallic member further comprises a central, elongate, leading entry-edge, such that when said member is coupled to said fence rail said leading entry-edge faces away from said fence rail and resides farther from said fence rail than any other portion of said member to thereby guide said member to slide more easily into an elongate opening formed in a wall of a hollow fence picket.

2. The fence system of claim 1, wherein the non-metallic member is constructed of rigid molded plastic.

3. The fence system of claim 1, wherein the non-metallic member is constructed of Fiberglass-reinforced nylon plastic.

4. The fence system of claim 1, wherein the non-metallic member further comprises means for engaging the picket at three separate, spaced-apart contact points.

5. The fence system of claim 1 wherein the non-metallic member further comprises an engagement surface that faces the fence rail, and wherein said engagement surface extends in a transverse, non-parallel orientation with respect to a side-surface of the fence rail.

6. The fence system of claim 5, wherein the non-metallic member further comprises an upper, beveled guide edge, such that when said member is coupled to said fence rail said upper, beveled guide edge extends downwardly toward said fence rail in a proximal-to-distal direction, terminating at the engagement surface to thereby guide a wall of the hollow fence picket into an area between said rail and said engagement surface.

7. The fence system of claim 1, wherein the non-metallic member has a non-uniform thickness.

8. The fence system of claim 1, wherein the non-metallic member further comprises at least one engagement finger configured to interact with the picket.

9. The fence system of claim 8, wherein said non-metallic member further comprises a fastening means for engaging against the picket in an interference fit.

10. The fence system of claim 1, wherein said non-metallic member further comprises a wider, lower portion.

11. A fence assembly system comprising:

an attaching means for attaching a fence picket to a fence rail such that said picket resides in an upwardly-extending position when the fence rail resides in a laterally-extending position;

wherein said attaching means further comprises (i) a fastener for engaging against the picket at three separate, spaced-apart contact points, and (ii) a coupling means for rotatably coupling the fastener to the fence rail; and wherein said fastener further comprising a central, elongate, leading entry-edge, such that when said fastener is coupled to said fence rail said leading entry-edge faces away from said fence rail and resides farther from said fence rail than any other portion of said fastener to thereby guide said fastener to slide more easily into an elongate opening formed in a wall of a hollow fence picket.

12. The fence assembly system of claim 11, wherein the fastener further comprises an upper, beveled guide edge and an engagement surface, such that when said fastener is coupled to said fence rail said upper, beveled guide edge extends downwardly toward said fence rail in a proximal-to-distal direction, terminating at the engagement surface to thereby guide a wall of the hollow fence picket into an area between said rail and said engagement surface.

13. The fence assembly system of claim 11, wherein the fastener is formed from a non-metallic material having elastic memory.

14. The fence assembly system of claim 11, wherein the fastener is constructed of rigid molded plastic.

15. The fence assembly system of claim 11, wherein the fastener is constructed of Fiberglass-reinforced nylon plastic.

16. The fence assembly system of claim 11, wherein said fastener further comprises a wider, lower portion.

17. A fence assembly system comprising:

an attaching means for attaching a fence picket to a fence rail such that said picket resides in an upwardly-extending position when the fence rail resides in a laterally-extending, position;

wherein the attaching means comprises (i) an elongate member, and (ii) coupling means for rotatably coupling the elongate member to the fence rail;

wherein the elongate member includes a central, elongate, leading entry-edge, such that when said elongate member is coupled to said fence rail said leading entry-edge faces away from said fence rail and resides farther from said fence rail than any other portion of said elongate member to thereby guide said elongate member to slide more easily into an elongate opening formed in a wall of a hollow fence picket.

18. The fence assembly system of claim 17, wherein the elongate member further comprises a eloped back surface, such that when the elongate member is coupled to the fence rail said sloped back surface slopes from the leading entry-edge towards the fence rail to thereby guide said elongate member to slide more easily into an elongate opening formed in a wall of a hollow fence picket.

19. The fence assembly system of claim 18, wherein the sloped back surface has a V shaped cross section.

20. The fence assembly system of claim 17, wherein the elongate member further comprises an upper, beveled guide edge and an engagement surface, such that when said elongate member is coupled to said fence rail said upper, beveled guide edge extends downwardly toward said rail in a proximal-to-distal direction, terminating at the engagement surface to thereby guide a wall of the hollow fence picket into an area between said rail and said engagement surface.

21. The fence assembly system of claim 18, wherein the elongate member further comprises means for engaging the picket at three separate, spaced-apart contact points.

22. The fence assembly system of claim 17, wherein the elongate member is constructed of a non-metallic material having elastic memory.

23. The fence assembly system of claim 17, wherein the elongate member is constructed of rigid molded plastic.

24. The fence assembly system of claim 17, wherein the elongate member is constructed of Fiberglass-reinforced nylon plastic.

25. The fence assembly system of claim 17, wherein said elongate member further comprises a wider, lower portion.

26. A fence assembly system comprising:

an attaching means for attaching a fence picket to a fence rail such that said picket resides in an upwardly-extending position when the fence rail resides in a laterally-extending position;

wherein said attaching means further comprises (i) a fastener, and (ii) a coupling means for rotatably coupling the fastener to a side-surface of the fence rail;

wherein the fastener further comprises an engagement surface that faces the fence rail when the coupling means couples the fastener to said fence rail, and wherein said engagement surface extends in a transverse, non-parallel orientation with respect to the side-surface of the fence rail; and wherein the fastener further comprises a central, elongate, leading entry-edge, such that when said fastener is coupled to said fence rail said leading entry-edge faces away from said fence rail and resides farther from said fence rail than any other portion of said fastener to thereby guide said fastener to slide more easily into an elongate opening formed in a wall of a hollow fence picket.

27. The fence assembly system of claim 26, wherein the fastener further comprises means for engaging the picket at three separate, spaced-apart contact points.

28. The fence assembly system of claim 26, wherein the fastener is constructed of a material having elastic memory.

29. The fence assembly system of claim 26, wherein the fastener is constructed of rigid molded plastic.

30. The fence assembly system of claim 26, wherein the fastener is constructed of Fiberglass-reinforced nylon plastic.

31. The fence assembly system of claim 26, wherein the attaching means further comprises means for attaching a hollow fence picket to a fence rail, and wherein the fastener further comprises an upper, beveled guide edge, such that when said fastener is coupled to said fence rail said upper, beveled guide edge extends downwardly toward said fence rail in a proximal-to-distal direction, to thereby guide a wall of the hollow fence picket into the area between said rail and said engagement surface.

32. The fence assembly system of claim 26, wherein said fastener further comprises a wider, lower portion.

33. A fence assembly system comprising:

an attaching means for attaching a fence picket to a fence rail such that said picket resides in an upwardly-extending position when the fence rail resides in a laterally-extending position;

wherein the attaching means comprises (i) a fastener having a non-uniform thickness and elastic memory, and (ii) a coupling means for rotatably coupling the fastener to the fence rail; and wherein the fastener further comprises a central, elongate, leading entry-edge, such that when said fastener is coupled to said fence rail said leading entry-edge faces away from said fence rail and resides farther from said fence rail than any other portion of said fastener to thereby guide said fastener to slide more easily into an elongate opening formed in a wall of a hollow fence picket.

34. The fence assembly system of claim 33, wherein a portion of the picket is slidably inserted between a portion of the fastener and the rail; such that said elastic memory of said fastener is sufficient to cause the fastener to compressively hold the picket in place between said fastener and said rail.

35. The fence assembly system of claim 33 wherein the fastener further comprises an engagement surface that faces the fence rail when the coupling means couples the fastener to said fence rail, and wherein said engagement surface extends in a transverse, non-parallel orientation with respect to the side-surface of the fence rail when the fence picket is attached to the fence rail in the upwardly-extending orientation.

36. The fence assembly system of claim 33 wherein the fastener further comprises an engagement surface that faces the fence rail when the coupling means couples the fastener to said fence rail, and wherein said engagement surface extends in a parallel orientation with respect to the side-surface of the fence rail when the fence picket is attached to the fence rail in the upwardly-extending orientation.

37. The fence assembly system of claim 34 wherein the fastener further comprises an engagement surface that faces the fence rail when the coupling means couples the fastener to said fence rail, and wherein said engagement surface extends in a transverse, non-parallel orientation with respect to the side-surface of the fence rail when the fence picket is attached to the fence rail in the upwardly-extending orientation.

38. The fence assembly system of claim 41 wherein the fastener further comprises an engagement surface that faces the fence rail when the coupling means couples the fastener to said fence rail, and wherein said engagement surface extends in a parallel orientation with respect to the side-surface of the fence rail when the fence picket is attached to the fence rail in the upwardly-extending orientation.

39. The fence assembly system of claim 35, wherein the fastener further comprises at least one engagement finger configured to interact with the picket.

40. The fence assembly system of claim 36, wherein the fastener further comprises at least one engagement finger configured to interact with the picket.

41. The fence assembly system of claim 33, wherein the fastener further comprises means for engaging the picket at three separate, spaced-apart contact points.

42. The fence assembly system of claim 33, wherein the fastener is constructed of a non-metallic material having elastic memory.

43. The fence assembly system of claim 33, wherein the fastener is constructed of rigid molded plastic.

44. The fence assembly system of claim 33, wherein the fastener is constructed of Fiberglass-reinforced nylon plastic.

45. The fence assembly system of claim 33, wherein the attaching means further comprises means for attaching a hollow fence picket to a fence rail and an engagement surface, and wherein the fastener further comprises an upper, beveled guide edge, such that when said fastener is coupled to said fence rail said upper beveled, guide edge extends downwardly toward said fence rail in a proximal-to-distal direction, to thereby guide a wall of the hollow fence picket into an area between said rail and said engagement surface.

46. The fence assembly system of claim 33, wherein said fastener further comprises a wider, lower portion.

47. A fence assembly system comprising:

an attaching means for attaching a fence picket to a fence rail such that said picket resides in an upwardly-extending position when the fence rail resides in a laterally-extending position;

wherein the attaching means comprises (i) a fastener having a wider lower portion terminating in at least two engagement fingers, and (ii) coupling means for rotatably coupling the fastener to the fence rail.

48. The fence assembly system of claim 47, wherein the fastener is constructed of a non-metallic material having elastic memory.

49. The fence assembly system of claim 48, wherein the non-metallic fastener is constructed of a rigid molded plastic.

50. The fence assembly system of claim 48, wherein the non-metallic fastener is constructed of Fiberglass-reinforced nylon plastic.

51. The fence assembly system of claim 47, wherein the fastener further comprises a narrower upper portion configured to engage the picket to the rail.

52. The fence assembly system of claim 51, wherein the narrower upper portion of the fastener is configured to engage the picket to the rail in a friction fit.

53. The fence assembly system of claim 47, wherein the elongate member further comprises means for engaging the picket at three separate, spaced-apart contact points.

54. The fence assembly system of claim 47, wherein the attaching means further comprises means for attaching a hollow fence picket to a fence rail and an engagement surface, and wherein the fastener further comprises an upper, beveled guide edge, such that when said fastener is coupled to said fence rail said upper, beveled guide edge extends downwardly toward said fence rail in a proximal-to-distal direction, to thereby guide a wall of the hollow fence picket into an area between said rail and said engagement surface.

55. The fence assembly system of claim 47, wherein said fastener further comprises a wider, lower portion.

56. A fence assembly system comprising:

an attaching means for attaching a fence picket to a fence rail such that said picket resides in an upwardly-extending position when the fence rail resides in a laterally-extending position;

wherein said attaching means further comprises (i) a fastening means for engaging against the picket in an interference fit at at least one contact point, and (ii) a coupling means for rotatably coupling the fastener to the fence rail; and wherein the attaching means further comprises a plurality of fastening means for engaging in an interference fit against the picket at a plurality of contact points.

57. The fence assembly system of claim 56, wherein the picket includes at least one engagement space formed therein, and wherein the fastening means comprises at least one engagement member configured and arranged to be (i) inserted into at least one engagement space that is formed in a picket, and (ii) to engage against edges forming said engagement space, to thereby form the interference fit at the contact point.

58. The fence assembly system of claim 56, wherein the picket includes a plurality of engagement spaces formed therein, and wherein the fastening means comprises a plurality of engagement members configured and arranged to be (i) inserted into the plurality of engagement spaces that is formed in a picket, and (ii) to engage against edges forming said engagement spaces, to thereby form the interference fit at the contact points.

59. The fence assembly system of claim 56, wherein the attaching means further comprises a plurality of fastening means for engaging in an interference fit against the picket at a plurality of separate, spaced-apart contact points.

60. The fence assembly system of claim 59, wherein the picket includes a plurality of separate, spaced-apart engagement spaces formed therein, and wherein the fastening means further comprises a plurality of separate, spaced-apart engagement members configured and arranged to be (i) inserted into the plurality of engagement spaces that is formed in a picket, and (ii) to engage against edges forming said engagement spaces, to thereby form the interference fit at the contact points.

61. The fence assembly system of claim 56, wherein the fastening means further comprises an elongate member constructed to engage the picket at three separate, spaced-apart contact points.

62. The fence assembly system of claim 56, wherein the fastening means further comprises an elongate member constructed of a non-metallic material having elastic memory.

63. The fence assembly system of claim 56, wherein the fastener further comprises means for engaging the picket at three separate, spaced-apart contact points.

64. The fence assembly system of claim 56, wherein the fastener is constructed of a non-metallic material having elastic memory.

65. The fence assembly system of claim 56, wherein the fastener is constructed of rigid molded plastic.

66. The fence assembly system of claim 56, wherein the fastener is constructed of Fiberglass-reinforced nylon plastic.

67. The fence assembly system of claim 56, wherein the attaching means further comprises means for attaching a hollow fence picket to a fence rail, and wherein the fastener further comprises an upper, beveled guide edge, such that when said fastener is coupled to said fence rail said upper, beveled guide edge extends downwardly toward said fence rail in a proximal-to-distal direction, to thereby guide a wall of the hollow fence picket into an area between said rail and said fastener.

68. The fence assembly system of claim 56, wherein said fastener further comprises a wider, lower portion.

69. The fence assembly system of claim 56, wherein said fastener further comprises a wider, lower portion terminating in at least one engagement member.

70. A device for the slidable attachment of adjacent members of a fence system, comprising:

a fastener configured and adapted for attachment to a first member, the fastener constructed such that a second member may be slidably inserted between the fastener and the first member;

wherein the fastener includes locking means configured to interact with receiving means disposed on the second member, such that the interaction of the locking means with the plurality of holes receiving means results in the first and second members being fastened such that the second member can no longer be slidably removed from the first member; and wherein the locking means comprises a plurality of projections disposed on the fastener, and wherein the receiving means comprises holes formed in the second member.

71. The device of claim 70, wherein the first member consists of a fence rail.

72. The device of claim 71, wherein the second member consists of a fence picket.

73. A fence assembly system comprising:

a fence rail supportable in a laterally-extending position;

a plurality of fence pickets; and attaching means for attaching the fence pickets to the fence rail such that said pickets reside in an upwardly-extending position when the fence rail resides in the laterally-extending position, said attaching means comprising a non-metallic member having elastic memory;

wherein the attaching means comprises (i) a non-metallic fastener having non-uniform thickness and elastic memory, (ii) wherein the fastener is configured to engage against the picket at three separate, spaced-apart contact points, (iii) wherein the fastener includes a central, elongate, leading entry-edge, such that when said fastener is coupled to said fence rail said leading entry-edge faces away from said fence rail and resides farther from said fence rail than any other portion of said fastener to thereby guide said fastener member to slide more easily into an elongate opening formed in a wall of a hollow fence picket, (iv) wherein the fastener further comprises an engagement surface that faces the fence rail when the coupling means couples the fastener to said fence rail, and wherein said engagement surface extends in a transverse, non-parallel orientation with respect to the side-surface of the fence rail, (v) wherein the fastener further includes an upper, beveled guide edge, such that when said fastener is coupled to said fence rail said upper, beveled guide edge extends downwardly toward said fence rail in a proximal-to distal direction, terminating at the engagement surface to thereby guide a wall of the hollow fence picket into an area between said rail and said engagement surface, (vi) wherein the fastener has a narrower upper portion configured to engage the picket to the rail, (vii) wherein the fastener has a wider, lower portion terminating in two engagement fingers configured to engage two corresponding engagement spaces on the wall of a hollow fence picket in an interference fit, and (viii) coupling means for rotatably coupling the fastener to the fence rail.

74. The fence assembly system of claim 73, wherein the fastener further comprises a sloped back surface, such that when the fastener is coupled to the fence rail said sloped back surface slopes from the leading entry-edge towards the fence rail to thereby guide said fastener to slide more easily into an elongate opening formed in a wall of a hollow fence picket.

75. The fence assembly system of claim 74, wherein the sloped back surface has a V shaped cross section.

76. The fence assembly system of claim 73, wherein the fastener is constructed of Fiberglass-reinforced nylon plastic.

77. A fence assembly system comprising:

an attaching means for attaching a fence picket to a fence rail such that said picket resides in an upwardly-extending position when the fence rail resides in a laterally-extending position;

wherein the attaching means is configured and dimensioned to be attached to a fence rail in an operational position, said attaching means further comprising ah elongate fastener body having elastic memory and a central, elongate, leading entry-edge pointing outwardly along, and in a direction perpendicular to, a length of the fastener body such that when said fastener body is attached to said fence rail in the operational position said leading entry-edge faces away from said fence rail and resides farther from said fence rail than any other portion of said fastener body to thereby guide a hollow fence picket relative to said fastener body to slide more easily upon said fastener body with said fastener body extending through an elongate opening formed in a wall of said hollow fence picket.

78. A fence assembly system comprising:

an attaching means for attaching a fence picket to a fence rail such that said picket resides in an upwardly-extending position when the fence rail resides in a laterally-extending position;

wherein the attaching means comprises (i) a fastener having a non-unitorm thickness and elastic memory, and (ii) coupling means for rotatably coupling the fastener to the fence rail;

wherein the fastener further comprises an engagement finger and an engagement surface, said engagement surface facing the fence rail when the coupling means couples the fastener to said fence rail, said engagement surface being disposed between the engagement finger and the coupling means when the fastener is coupled to the rail;

wherein said engagement surface extends in a parallel orientation with respect to a side-surface of the fence rail when the fence picket is attached to the fence rail in the upwardly-extending orientation; and wherein said fence picket further comprises a locking hole, and wherein said engagement finger engages the locking hole in an interference fit when the fence picket is attached to the fence rail in the upwardly-extending orientation.

* * * * *